US007270197B2

(12) United States Patent
Püttmann

(10) Patent No.: US 7,270,197 B2
(45) Date of Patent: Sep. 18, 2007

(54) STEERABLE SOIL DISPLACEMENT HAMMER

(75) Inventor: Franz-Josef Püttmann, Lennestadt (DE)

(73) Assignee: Tracto-Technik GmbH, Lennestadt (DE)

( * ) Notice: Subject to any disclaimer, the term of this patent is extended or adjusted under 35 U.S.C. 154(b) by 120 days.

(21) Appl. No.: 10/399,834

(22) PCT Filed: Oct. 19, 2001

(86) PCT No.: PCT/EP01/12112

§ 371 (c)(1),
(2), (4) Date: Sep. 23, 2003

(87) PCT Pub. No.: WO02/35049

PCT Pub. Date: May 2, 2002

(65) Prior Publication Data

US 2004/0040748 A1 Mar. 4, 2004

(30) Foreign Application Priority Data

Oct. 23, 2000 (DE) ..... 100 52 574

(51) Int. Cl.
*E21B 7/04* (2006.01)

(52) U.S. Cl. ..... 175/61; 175/62; 175/73

(58) Field of Classification Search ..... 175/19, 175/57, 61, 73, 74, 293, 40, 62
See application file for complete search history.

(56) References Cited

U.S. PATENT DOCUMENTS

| | | | | |
|---|---|---|---|---|
| 4,694,913 A | | 9/1987 | McDonald et al. | |
| 4,823,888 A | * | 4/1989 | Smet | 175/45 |
| 4,907,658 A | | 3/1990 | Stangl et al. | |
| 5,078,218 A | * | 1/1992 | Smet | 175/45 |
| 5,322,391 A | | 6/1994 | Fisk | |
| 5,350,254 A | | 9/1994 | Fisk et al. | |
| 5,597,046 A | | 1/1997 | Fisk | |

FOREIGN PATENT DOCUMENTS

| | | | |
|---|---|---|---|
| BE | 865 955 | | 7/1978 |
| DE | 29 11 419 | A1 | 11/1980 |
| DE | 37 35 018 | A1 | 4/1989 |
| DE | 39 11 467 | A1 | 10/1990 |
| DE | 92 07 047 | | 10/1992 |
| DE | 199 10 292 | A1 | 3/2000 |
| DE | 199 04 864 | A1 | 8/2000 |
| DE | 199 47 645 | C1 | 3/2001 |
| WO | WO94/05941 | | 3/1994 |
| WO | WO 01/25585 | A2 | 4/2001 |
| WO | PCT/EP01/12112 | | 2/2002 |
| WO | PCT/EP01/12112 | | 12/2002 |

* cited by examiner

*Primary Examiner*—Kenneth Thompson
*Assistant Examiner*—Nicole A Coy
(74) *Attorney, Agent, or Firm*—Cook, Alex, McFarron, Manzo, Cummings & Mehler, Ltd.

(57) ABSTRACT

The invention relates to a steerable soil displacement hammer for horizontal ground boring, comprising a body that can be rotated by means of a longitudinal element, and a thrust head that is mounted rotationally in relation to the body. A rotation of the body in relation to the thrust head causes the thrust head to pivot out into an asymmetrical constellation or to pivot to a symmetrical constellation. The invention also comprises a retaining feature which provides a hold in the environment and which permits a relative rotation of the body and simultaneous pivoting of the thrust head. The soil displacement hammer can be driven forwards or backwards and the retaining feature is situated in the area of the pivot axis of the thrust head.

5 Claims, 6 Drawing Sheets

STEERABLE SOIL DISPLACEMENT HAMMER

CROSS-REFERENCE TO RELATED APPLICATIONS

The invention relates to a steerable underground drilling or boring apparatus for forming horizontal bores in the ground having a forward drive head, which can rotate with respect to the boring apparatus body, and to a method for steering such an underground boring apparatus, and claims priority over German Patent Application 100 52 574.1, to whose contents reference is made.

BACKGROUND OF INVENTION

Fundamentally, when boring underground, there is a need to guide the underground boring apparatus to a specific destination, or to move it on a desired track. Particularly when boring horizontally, the directional accuracy of the underground boring apparatus, which in some cases is used in particular underground in densely built-up regions with a complex infrastructure, plays a major role. Firstly, the underground boring apparatus must be able to accurately reach a destination trench, which is frequently tightly constrained, in order to carry a pipe or a cable to a desired position, or in order to make it possible to emerge from the earth's surface at a specific point. Secondly, uncontrolled deviation of the underground boring apparatus from the nominal boring axis can lead to damage to underground pipelines or fittings.

In the last 20 years, numerous underground boring apparatuses and methods for such appliances have therefore been developed in the prior art, in order to steer an underground boring apparatus of this type as accurately as possible, or to move it in a straight line as reliably as possible.

The majority of the underground boring apparatuses which have been developed either operate on the principle that the boring apparatus has a forward-drive head which can be moved from a central or symmetrical position to an asymmetric position in order to initiate a turn for the underground boring apparatus (Group I), or they have an asymmetric forward-drive head, with the forward-drive head or the underground boring apparatus being rotated continuously when moving in a straight line, and with the rotation being interrupted at a specific angular position in order to initiate a turn (Group II).

A Group I appliance, that is to say an appliance with an adjustable forward-drive head, is described, for example, in DE 37 35 018 A1. Appliances such as these have a mechanism in order either to pivot a forward-drive head (which is symmetrical in the initial position) out of the symmetrical position for example by using an eccentric ring or moving an eccentrically mounted symmetrical forward-drive head by rotation from the boring axis relative to the appliance. In all cases, the mechanism (which can be operated mechanically or hydraulically) leads to the appliance being moved from a symmetrical "straight ahead" basic arrangement to an asymmetric "turning" arrangement. It is necessary to know the relative position of the forward-drive head with respect to the underground boring apparatus in order to control these appliances. This relative position can be transmitted by means of appropriate sensors to an operator, who can then use further measurement and display devices to determine the position of the underground boring apparatus, and to change the movement direction.

In Group II steerable underground boring apparatuses, such as those described, for example, in U.S. Pat. No. 4,907,658, are permanently asymmetric, for example inclined, forward-drive head leads to a continuous steering movement of the underground boring apparatus when it is being driven forward. In order to move straight ahead, the underground boring apparatus or the forward-drive head is caused to rotate, which leads to a tumbling boring movement of the appliance, running essentially straight ahead. In order to maintain the continuous rotation of the head or of the appliance, U.S. Pat. No. 4,694,913 provides a mechanical device which is arranged outside the borehole and uses a linkage to rotate the underground boring apparatus. Although this apparatus and procedure allow the underground boring apparatus to be controlled to a certain extent, they involve considerable design and mechanical complexity since, in addition to the system for driving the underground boring apparatus forward, a system must be provided for rotation, and a linkage must be provided for transmitting the rotation. The linkages are relatively rigid, impede the steering process, and cannot be moved from the trench to the surface. In some appliances such as these, a constricted flexible linkage is used as the first linkage behind the underground boring apparatus in order to allow the underground boring apparatus to carry out any steering movements whatsoever.

Other underground boring apparatuses avoid this complexity for moving in a straight line by using their own systems for rotating the underground boring apparatus or the forward-drive head, as is described, by way of example, in DE 39 11 467 A1.

In all cases, the advantage of the steerability of an underground boring apparatus leads to not inconsiderable use of materials, costs and operating complexity.

In addition to horizontal boring methods using underground boring apparatuses, boring methods and apparatuses are also known in which a linkage which is provided with a forward-drive head is introduced into the ground via a forward-drive unit which acts outside the borehole, as is described, by way of example, in DE 92 07 047 U1. In this method, the linkage which is required for controlling or rotating the asymmetric forward-drive head is already provided for the forward-drive and is used for rotation, so that the problem of rotation when moving underground boring apparatuses straight ahead does not arise. However, extensive equipment must be provided for each borehole for this purpose and, in particular, must be transported (linkage, drive), thus increasing the amount of effort and the costs.

PCT-WO 94/05941, to which reference is hereby made, attempts to solve the problem of steering an underground boring apparatus by means of a Group I appliance, in which the forward-drive head can be moved from a symmetrical position (boring in a straight line) to an asymmetric arrangement (turning) by rotation relative to the underground boring apparatus. In this appliance, the forward-drive head is in the form of a cone with guide plates which extend from the tip of the head along the forward drive axis, in order to fix the head when driving forward and during steering, and has a longitudinal axis which is inclined to the forward drive axis of the appliance. The forward-drive head has a rear contact surface, which makes contact with a front contact surface on the underground boring apparatus, and on which the forward-drive head is rotated. The plane of these contact surfaces is inclined to the appliance longitudinal axis. This makes it possible to rotate the appliance casing about its longitudinal axis, while the earth holds the forward-drive head firmly by means of the guide plates.

Such casing rotation allows the forward-drive head to be moved to an eccentric position with respect to the appliance casing, in which position it will turn.

The rotation angle—referred to as the difference angle in the following text—between the forward-drive head and the appliance casing or the two limit positions of the forward-drive head is governed by a driver pin, which is connected to the forward-drive head and engages in a circular slot in the appliance casing. When the pin is located at one end of the appliance slot, then the forward-drive head is in its position for moving in a straight line (straight-ahead position), while, at the other end of the appliance slot, it is located in the position for turning (steering position).

In order to move the underground boring apparatus from moving in a straight line onto a specific turning track, the appliance casing can be rotated by means of the compressed-air hose sufficiently for the appliance to achieve the desired angular position (initial position) for the desired turning track.

This rotational movement may be composed of two phases. In this case, the first phase is for only the appliance casing to be rotated first of all, until the driver pin has moved through the entire difference angle from the straight-ahead position to the steering position. As soon as this has been done, the forward-drive head and the appliance casing are coupled to one another for the rest of the rotational movement, that is to say the appliance casing and the forward-drive head rotate together until the initial position for turning is reached. In the process, considerable forces must be applied, since the deflection of the forward drive head causes a lateral movement of the surrounding earth and the forward-drive head has to move the earth by means of its guide plates during the rotation process. The force required is exacerbated by the fact that the earth has been compressed by the bore face of the forward drive head.

It is necessary to determine, above the ground, the angular position, with respect to the appliance longitudinal axis, in which the steering position is located, that is to say that end of the casing slot which governs turning.

If, for example, the steering position is in the 6 o'clock position when boring in a straight line and it is intended to move the underground boring apparatus from this position to a curved track running upward in a vertical plane, then the steering position is changed to the 12 o'clock position. This is done by using compressed air run through a compressed-air hose to rotate the appliance casing. If the forward-drive head or its driver pin is in the straight-ahead position, then the appliance casing is first rotated through the difference angle on its own until the driver pin is located at the other slot end in the steering position, and then the casing is rotated, together with the forward-drive head which is now in the steering position, to the 12 o'clock position.

Since the steering head position is unknown outside the borehole, it is also impossible to find out how much hose rotation is required—with or without overcoming the difference angle—to move the steering position to the correct initial position for turning.

Owing to these difficulties, the appliance described above has been developed in DE 199 10 292 A1, to which reference is hereby made, such that, when changing from movement in a straight line to turning, the forward-drive head position at that time with respect to the appliance casing and the position of the driver pin in the casing slot are determined first of all, and the appliance together with the forward-drive head is then set to the desired turning track, or is moved to the initial position for turning, by rotating the compressed-air hose.

However, the problem still remains that the forward drive head is fixed in the highly compressed earth surrounding it. It is virtually impossible to use the appliance described in PCT WO 94/05941 in practice, since the forces required to rotate the underground boring apparatus and the forward drive head are so large that rotation is frequently impossible or leads to kinking of the compressed air hose. Furthermore, the guide plates on the forward-drive head often result in uncontrolled deflection of the appliance in an undesirable direction, for example due to stones or the like.

DE 199 47 645 A1 describes a process in which the underground boring apparatus is rotated manually between two or more positions on a path section basis via the supply line, that is to say discontinuously via the supply line, with the forward-drive head being permanently arranged asymmetrically.

For turning, the underground boring apparatus is driven forward without any change in its angular position over a specific path section. For moving in a straight line, the path section-by-path section oscillating movement makes it possible to change between the 12 o'clock position and the 6 o'clock position. When moving in a straight line, this leads to an oscillating movement in the vertical axis.

This method admittedly makes steering easier, since the forward drive head is no longer rotated relative to the underground boring apparatus and, in consequence, need not have any guide plates. However, when moving straight ahead, it is necessary to carry out a continuous to and fro steering movement by using compressed-air through the compressed air hose, which in some circumstances leads to undesirable control effort.

BRIEF SUMMARY

The invention is now based on the object of providing a method which allows an underground boring apparatus to be moved straight ahead and to be steered easily. The invention is also based on the object of providing an underground boring apparatus which is suitable for this method.

The object is achieved by a steerable underground boring apparatus according to the independent apparatus claims, and by a method for operating a steerable underground boring apparatus as claimed in the independent method claims.

Preferred embodiments are the subject matter of the dependent claims.

The present invention is based on the knowledge that the guide plates which are arranged on the conventional forward drive head are not required for operation of the steerable underground boring apparatus. This is because, when the underground boring apparatus is being driven forward, the forward drive head essentially maintains its original steering position setting (path of least resistance) just on the basis of the earth surrounding it. In consequence, when driving forward, no forces are produced in the ground which cause the forward drive head to be deflected from straight ahead motion or cause it to be pivoted back from the steering position. In fact, the forces which act on the forward drive head while boring actually lead to the forward drive head essentially maintaining its position with respect to the underground boring apparatus.

In order to change the steering position of the forward drive head with respect to the underground boring apparatus, it is now in fact necessary to ensure that rotation of the body of the underground boring apparatus via the supply line does not at the same time lead to undesirable rotation of the forward drive head, so that its longitudinal axis does not change with respect to the appliance longitudinal axis. In the prior art, this function is likewise carried out by the guide plates on the forward drive head.

According to the invention, this problem is solved by providing holding means only in the rear region of the forward drive head, that is to say in the vicinity of the axis about which the forward drive head pivots.

In one particularly preferred embodiment, the holding means are in the form of an oversized forward drive head. This has the advantage that the forward drive head can be rotated, since only the greater frictional resistance of the holding means in the ground may be overcome, although the holding means also ensure isolated rotation of the body, since a smaller friction resistance may be overcome for rotation of the boring apparatus body than for rotation of the forward drive head. In this case, the holding effect of the holding means can be increased as required by the choice of its shape, or can be reduced down to the relatively low but adequate holding force provided by an oversized head with a smooth outer surface.

In order also to avoid the pivoting resistance in the bore face, the underground boring apparatus according to the invention may have a device for reverse operation, and may be moved away from the bore face for steering. The front area of the forward drive head is then no longer surrounded by compressed earth, but lies freely in the channel in the earth with a full cross section, so that friction forces occur only in the rear area of the forward drive head during pivoting, and lateral movement of the earth during pivoting of the forward drive head is considerably reduced, and preferably avoided.

It is particularly advantageous to use the technique of moving the underground boring apparatus in reverse in conjunction with an oversize head, in order to carry out the steering process. The oversize forward drive head not only ensures that the body of the underground boring apparatus, which has a smaller diameter, can be rotated easily with the aid of the longitudinal element, (for example the supply line) while in the process ensuring that the head is held adequately in the ground, but also that the head finds an adequate pivoting space when pivoting, when the underground boring apparatus and hence the forward drive head have been moved backward, in order to remove the forward drive head from the bore face. However, the oversize section can also be provided separately from the forward drive head and can then be connected to the forward drive head via a coupling element.

In this case, it is advantageous for the forward drive head not to have any elements which cause displacement of the surrounding earth during pivoting once the underground boring apparatus has been moved back. In one embodiment of the invention, the oversize section can also be provided on an element, for example a ring, which does not change its axial position during pivoting of the forward drive head, so that there is no need to overcome any friction resistance of the earth during pivoting, either.

During pivoting of the head, the underground boring apparatus can be moved forward and backward two or more times, in order to further ease the steering process.

The underground boring apparatus is preferably equipped with a probe and roll sensors, in which case at least one Hall sensor can be used for detection of the steering direction of the forward drive head.

The invention will be explained in more detail in the following text with reference to an exemplary embodiment which is illustrated in the drawing, in which:

DETAILED DESCRIPTION OF THE EMBODIMENT

Figure 1:
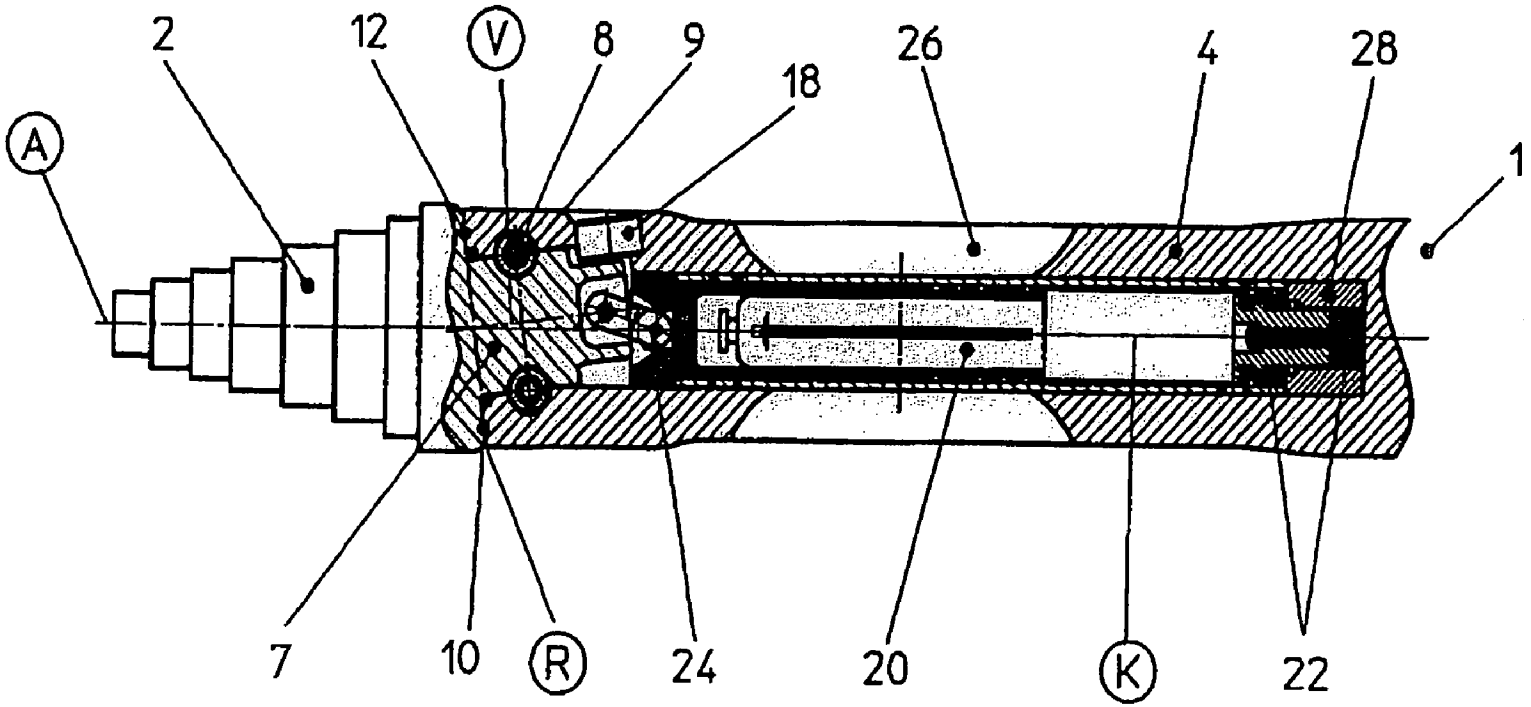
FIG. 1 shows an underground boring apparatus according to the invention in the symmetrical straight ahead position.

The underground boring apparatus 1 has a forward drive head 2 and a body 4 with a hammer mechanism. The head 2 has a rotation journal 7 and is mounted in the front end of the body via a rotating bearing 8 with clamping pins 9 such that it can rotate. The rotation journal 7 and the rotating bearing 8 are arranged such that the rotation axis V of the forward drive head 2 is arranged at an angle $\alpha$ with respect to the axis K of the body 4.

The rotation plane R, which is formed by the rear contact surface 10 of the forward drive head 2 and by the front contact surface 12 of the body 4, lies at right angles to the rotation axis V of the forward drive head. This plane, and hence also the rear contact surface 10 of the forward drive head, is likewise at an angle $\alpha$ with respect to the plane of symmetry or axis A of rotational symmetry of the forward drive head 2, with this angle $\alpha$ corresponding to the angle between the rotation journal axis and the axis of symmetry A. This means that the axis of symmetry A of the forward drive head 2 can be made to coincide with the axis K of the body 4. In this position, the underground boring apparatus is set to "move straight ahead".

For turning, the forward drive head 2 is pivoted about an axis at right angles to the plane of the drawing by rotating the body 4 about the axis K, so that the axis of symmetry A of the forward drive head 2 moves away from the axis K of the body. This can be achieved by means of the compressed air hose for the hammer mechanism (not shown).

In order to set the desired boring direction, the forward drive head 2 may also be rotated together with the body 4 via a stop 18, as soon as it has reached the "turning" (asymmetric) position.

Figure 2:
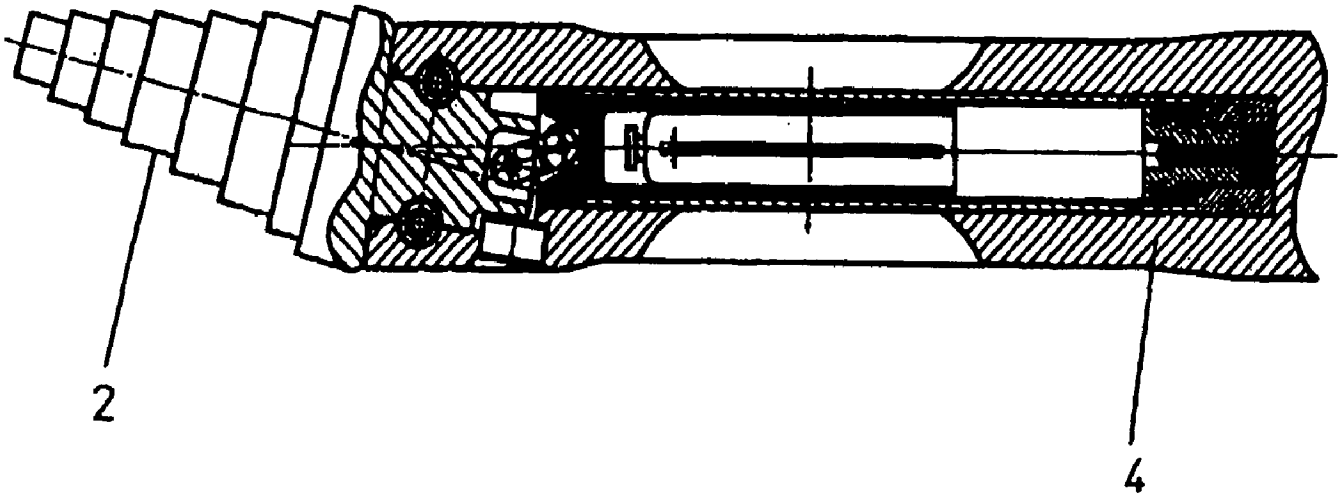
FIG. 2 shows the underground boring apparatus shown in FIG. 1, in an asymmetric turning position.
Figure 3:
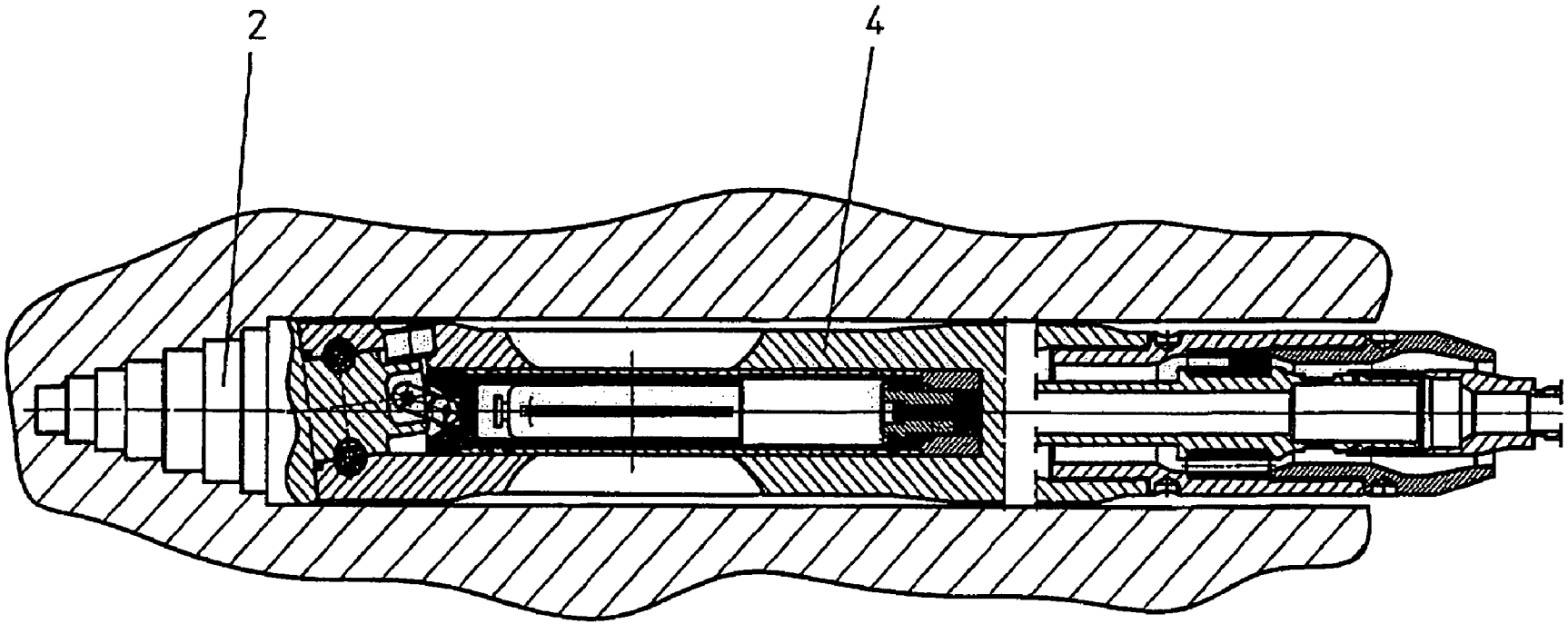
FIG. 3 shows the underground boring apparatus shown in FIG. 1, with the forward drive head located in the bore face.
Figure 4:
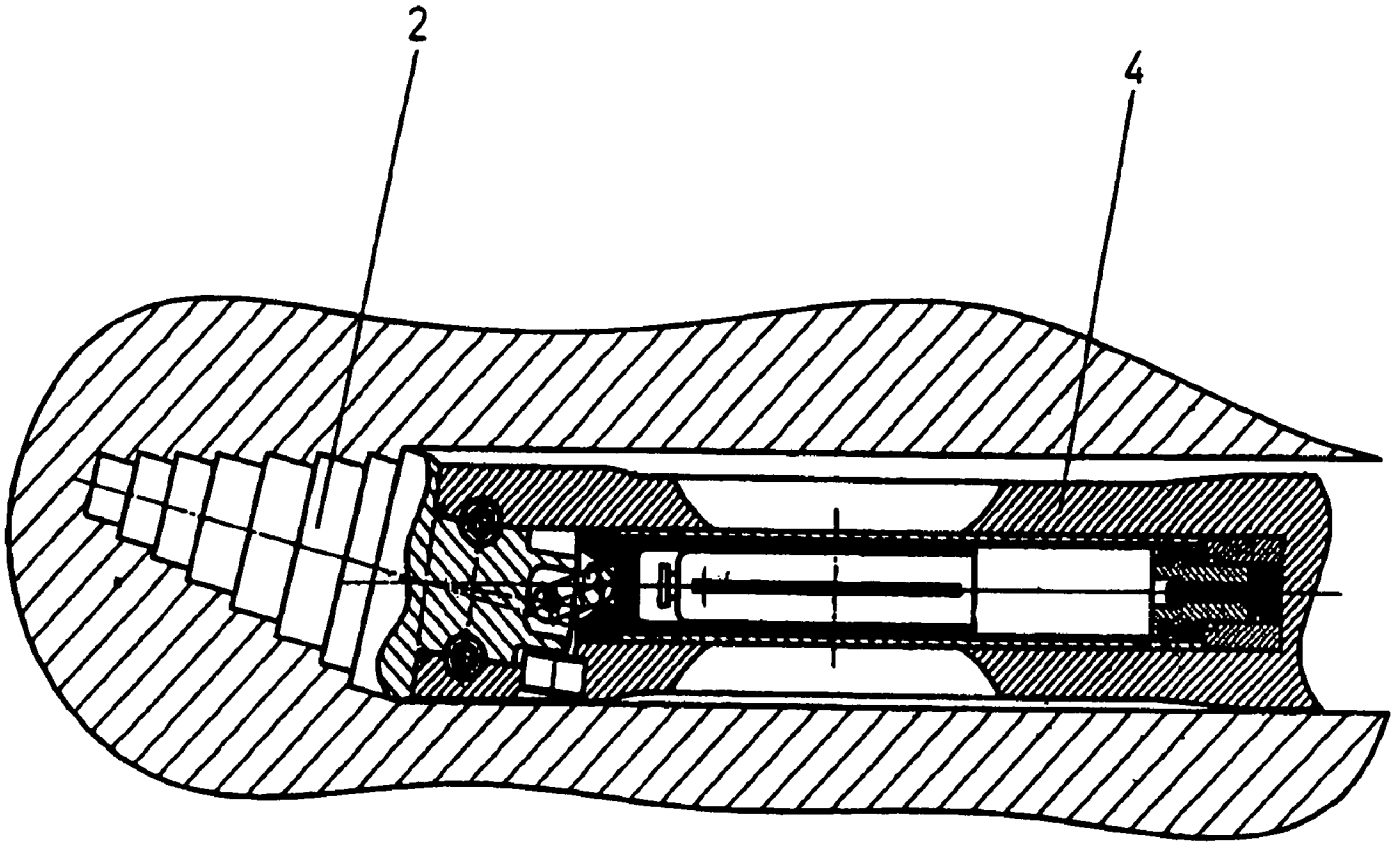
FIG. 4 shows the underground boring apparatus shown in FIG. 2, with the forward drive head located in the bore face.

As is shown in FIGS. 2 and 3, while boring, the forward drive head 2 is located in the bore face, where the earth is generally compressed and thus fixes the position of the forward drive head 2 with respect to the body 4, but at the same time making it more difficult or impossible for the forward drive head axis A to pivot with respect to the body axis K.

Figure 5:
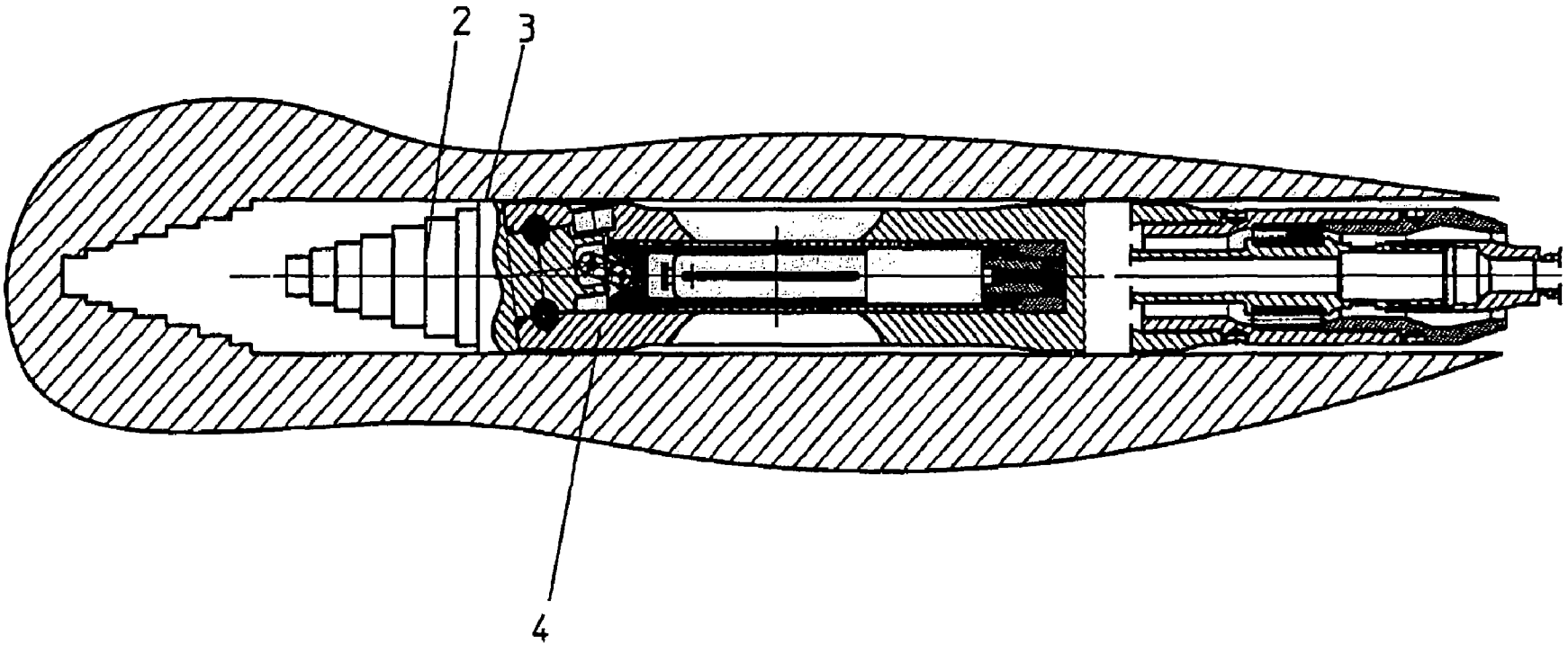
FIG. 5 shows the underground boring apparatus shown in FIG. 1 after moving backward, before the steering process.
Figure 6:
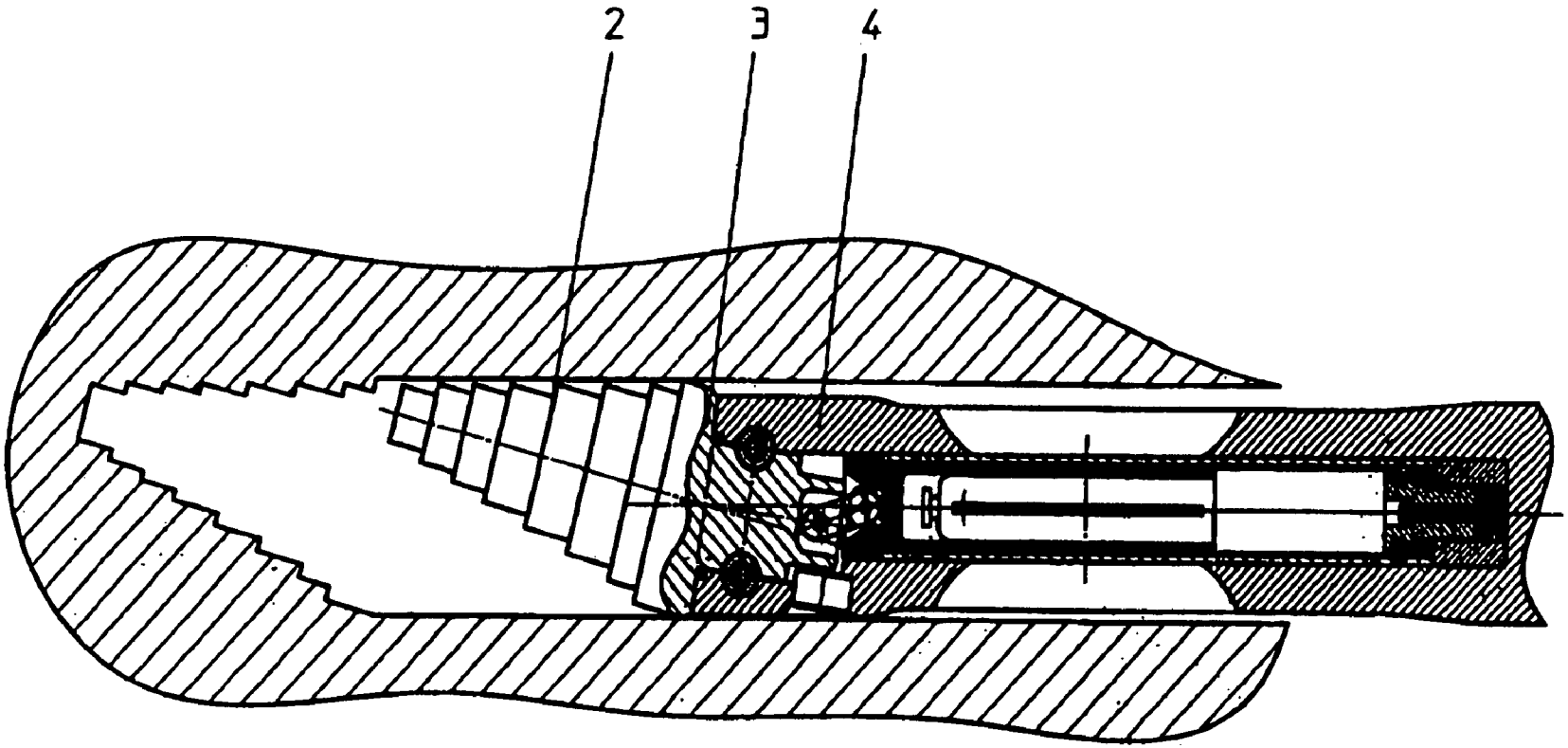
FIG. 6 shows the underground boring apparatus shown in FIG. 5, after the steering process.

As is shown in FIGS. 5 and 6, the underground boring apparatus can be moved backward away from the bore face by means of a hammer control process in order then to allow the axis A of the forward drive head to be pivoted without any problems within the earth channel into and out of the steering position.

The forward drive head 2, which is in the form of a stepped head, has an oversize section 3 at its rear end, close to the body.

The oversized section 3 not only ensures that the head can be pivoted without any problems, but also reduces the friction of the body 4 of the underground boring apparatus while at the same time fixing the forward drive head 2 in terms of rotation in the ground.

In order to make the steering process even easier, the underground boring apparatus can be moved forward and backward while carrying out the steering process.

The body has a probe with position Hall sensors 20 in order to determine the orientation of the forward drive head 2 with respect to the body 4. Buffers 22, 24 protect the probe 20 against the hammer effect of the forward drive unit of the underground boring apparatus. The body 4 has transmission slots 26 in order to improve the signal transmission from the probe, and has a rotation protection device 28 to ensure the reproducibility of the sensor signal with respect to the rotation angle between the forward drive head 2 and the body 4.

The invention claimed is:

1. A method for steering a steerable underground boring apparatus which is located in the bore face of a bore, said steerable underground boring apparatus having a rotatable body, said body having a longitudinal axis, and a forward-drive head, which is mounted to the front of said body, whereas a relative rotation of the body with respect to and about said longitudinal axis of the body leads to a pivoting of the forward-drive head between a symmetrical alignment and an asymmetric alignment with respect to said body, said forward-drive head having holding means for holding the forward-drive head in the bore against rotation, wherein said holding means are arranged in the area of the pivot axis of the forward-drive head and a longitudinal element which is connected to the body, including the steps of moving the underground boring apparatus back from the bore face by pulling the longitudinal element, rotating the body about the longitudinal axis by rotating the longitudinal element after said moving, thereby, causing a relative rotation between the body and the forward-drive head about a longitudinal axis of the body, which is frictionally held in the surrounding soil by means of the said holding means, so that the forward-drive head pivots between a symmetrical alignment and an asymmetric alignment with respect to said body.

2. The method as claimed in claim 1, further comprising the steps of:

moving forward the underground boring apparatus by pushing the longitudinal element until the forward-drive head reaches the bore face again.

3. The method as claimed in claim 1, wherein the underground boring apparatus is moved forward and backward during the rotation process by pushing and pulling the longitudinal element.

4. A steerable underground boring apparatus for boring horizontally in the earth, having a rotatable body which can be rotated by means of a longitudinal element, attached to said body, said body having a longitudinal axis, a forward-drive head having a rotation journal which is mounted to a front part of said body by a rotation bearing and fasteners, whereby said rotation bearing and fasteners allow the body to rotate relative to said forward-drive head, said forward-drive head having a longitudinal axis, said rotation journal having a rotation axis for the relative rotation between the body and the forward-drive head, said rotation axis of the rotation journal being arranged at an angle with respect to the longitudinal axis of the body and wherein the longitudinal axis of the forward-drive head is arranged with an angle with respect to said rotation axis, so that a relative rotation of the body with respect to the forward-drive head causes the forward-drive head to pivot from a symmetrical constellation of the forward-drive head into an asymmetric constellation, and a holding means for frictionally holding the forward-drive head in the surrounding area, preventing it from rotating about the longitudinal axis of the forward drive head when the body is rotated about the longitudinal axis of the body by means of the longitudinal element, wherein said holding means are arranged in the area of the forward-drive head, where it contacts the body.

5. The steerable underground boring apparatus as claimed in claim 4, wherein the angle between the rotation axis and the longitudinal axis of the body on one side and the rotation axis and the longitudinal axis of the forward-drive head on the other hand are equal.

* * * * *